US009868007B2

(12) United States Patent
Ho et al.

(10) Patent No.: US 9,868,007 B2
(45) Date of Patent: Jan. 16, 2018

(54) FOLDABLE TRAMPOLINE

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 0 days.

(21) Appl. No.: 15/044,542

(22) Filed: Feb. 16, 2016

(65) Prior Publication Data

US 2017/0232288 A1 Aug. 17, 2017

(51) Int. Cl.
*A63B 5/11* (2006.01)
*A63B 5/16* (2006.01)

(52) U.S. Cl.
CPC ..... *A63B 5/11* (2013.01); *A63B 2210/50* (2013.01)

(58) Field of Classification Search
CPC .... A63B 5/00; A63B 5/02; A63B 5/04; A63B 5/06; A63B 5/08; A63B 5/11; A63B 6/00
See application file for complete search history.

(56) References Cited

U.S. PATENT DOCUMENTS 4,331,329 A * 5/1982 Mirkovich ..... A63B 5/11 482/27
4,386,772 A * 6/1983 Wu ..... A63B 5/11 482/28
4,415,151 A * 11/1983 Daniels ..... A63B 5/11 482/28
5,533,948 A * 7/1996 Wilkinson ..... A63B 5/11 482/146
8,047,967 B1 * 11/2011 Teng ..... A63B 5/11 482/27
2005/0137061 A1 * 6/2005 Wang ..... A63B 5/11 482/28
2005/0197238 A1 * 9/2005 Parker ..... A63B 21/4029 482/142
2007/0072738 A1 * 3/2007 Lai ..... A63B 5/11 482/28
2007/0219053 A1 * 9/2007 Barufka ..... A63B 5/00 482/4
2008/0096744 A1 * 4/2008 Perry, Jr. ..... A61H 1/0218 482/144
2012/0063839 A1 * 3/2012 Mo ..... F16B 7/182 403/84

* cited by examiner

*Primary Examiner* — Nyca T Nguyen
(74) *Attorney, Agent, or Firm* — Blakely, Sokoloff, Taylor & Zafman LLP

(57) ABSTRACT

A foldable trampoline includes a tubular frame having a first section and a second section coupled to each other via a pair of frame hinges. The device further includes a flexible fabric stretched outwardly attached to the tubular frame to form a trampoline mat, wherein the tubular frame is configured to in an unfolded position or a folded position via the pair of frame hinges. When the tubular frame is in the unfolded position, the first section and the second section are laid out flat away from each other via the frame hinge to form a full-pie shape. When the tubular frame is in the folded position, the first section and the second section are folded towards to each other via the pair of frame hinges to form a half-pie shape, without having to remove the flexible fabric from the first section and second section.

20 Claims, 25 Drawing Sheets

FOLDABLE TRAMPOLINE

FIELD OF THE INVENTION

Embodiments of the present invention relate generally to physical training machines, and in particular, to exercise machines commonly referred to a foldable trampoline.

BACKGROUND

Whereas people today are more conscious of fitness thanks to the ever-improved living standard, fitness equipment has become very popular. However, some of the fitness equipment emphasizing sit up in bear hands may get too rough and violent resulting in stretch in larger angles that causes injuries to the user having overweighed problem or in middle ages or elder. Furthermore, the sit up may become so monotonous and the user may be disinterested very quickly. Besides, fitness equipment generally available in the market either consumes too much space at home or is very expensive, plus other factors, such as the users in a family whose age, physical strength vary, the confined space available at home, the limit to only one function, and nature and length of training session.

A jump exercise device such as a trampoline is commonly used to exercise one body part of a human body. Most of the trampolines are constructed in fixed structures. It takes a large storage space to store a trampoline. In order to save the storage space, users typically have to take it apart and store the parts individually. Such a disassembling process proves to be time consuming and inconvenient. In addition, such a configuration may also take a considerable amount time and effort to reassemble it.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Figure 1A:
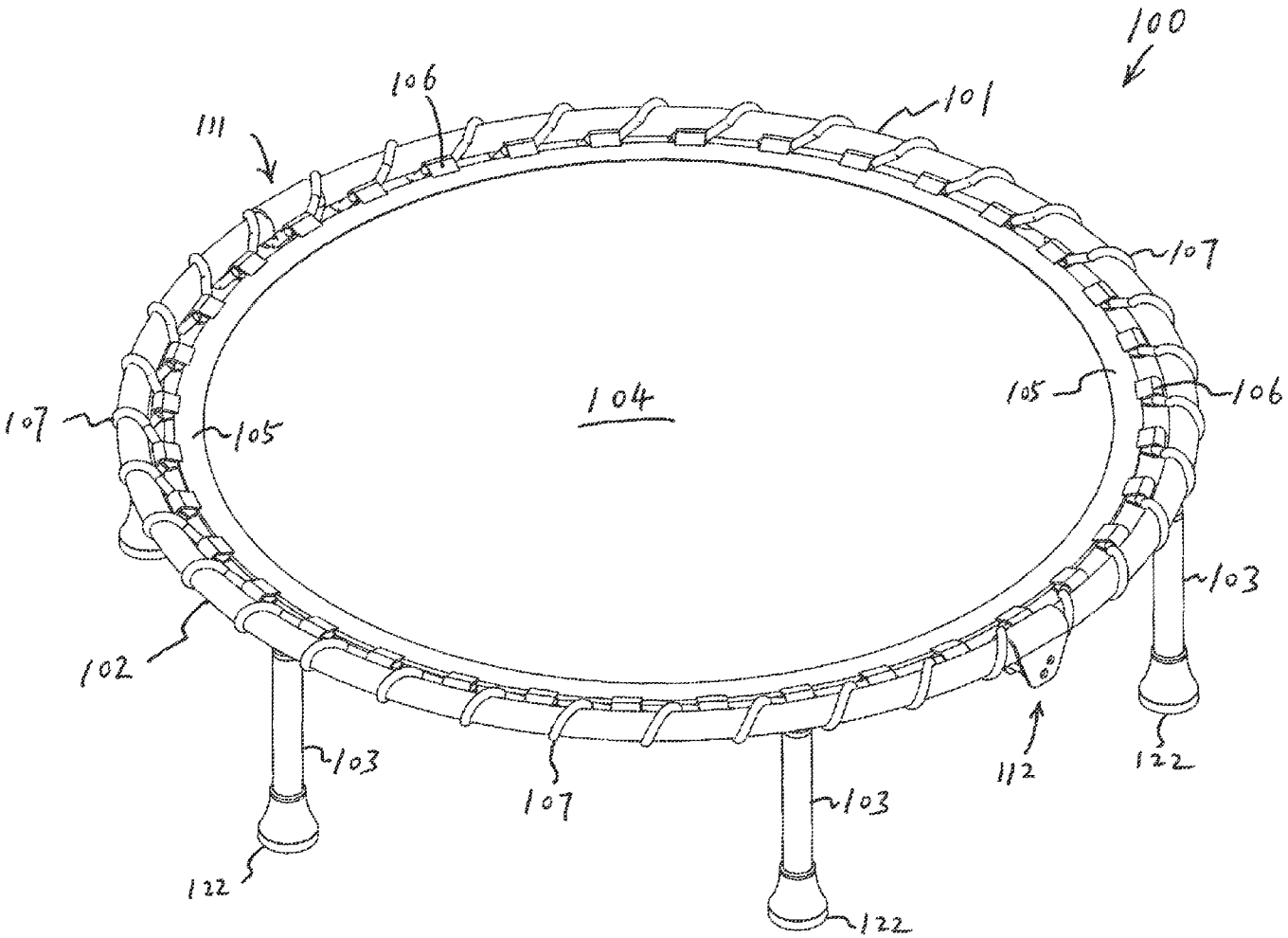
FIGS. 1A-1B show a perspective view of a trampoline device according to certain embodiments of the invention.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

According to some embodiments, a trampoline device includes a tubular frame having a first section and a second section coupled to each other via a pair of frame hinges. Each of the first section and the second section is formed in a substantially half circular shape. The trampoline device further includes a flexible fabric stretched outwardly attached to the tubular frame to form a trampoline mat or jumping mat. The tubular frame is configured to in an unfolded configuration or a folded configuration via the pair of frame hinges. When the tubular frame is in the unfolded configuration, the first section and the second section of the tubular frame are laid out or extended flat away from each other via the frame hinges to form a full-pie shape. When the tubular frame is in the folded configuration, the first section and the second section of the tubular frame are folded towards to each other via the pair of frame hinges, without having to remove the flexible fabric from the first and second sections of the tubular frame. The trampoline device further includes at least three legs attached to the tubular frame to provide support and to raise the tubular frame and the flexible fabric above a support platform (e.g., floor). In one embodiment, each of the legs is attached to the tubular frame via a leg hinge and each leg is foldable inwardly via a corresponding leg hinge towards a center of the tubular frame.

According to another embodiment, a trampoline device includes a tubular frame in a substantially circular shape and a flexible fabric stretched outwardly attached to the tubular frame to form a trampoline mat or jumping mat. The flexible fabric includes an array of belt loops or hooks disposed on the edge of the fabric. The belt loops allow a rope or string to be inserted therethrough to tighten the flexible fabric onto the tubular frame, by pulling the flexible fabric outwardly using the rope or string and wrapping the rope or string around the tubular frame, without having to use the metal spring required in a conventional trampoline. The trampoline device further includes at least three legs attached to the tubular frame to provide support and to raise the tubular frame and the fabric above a support platform (e.g., floor), when the legs are configured in an unfolded position. Each of the legs is individually foldable inwardly without being detached from the tubular frame, when the leg is configured in a folded position.

Figure 1B:
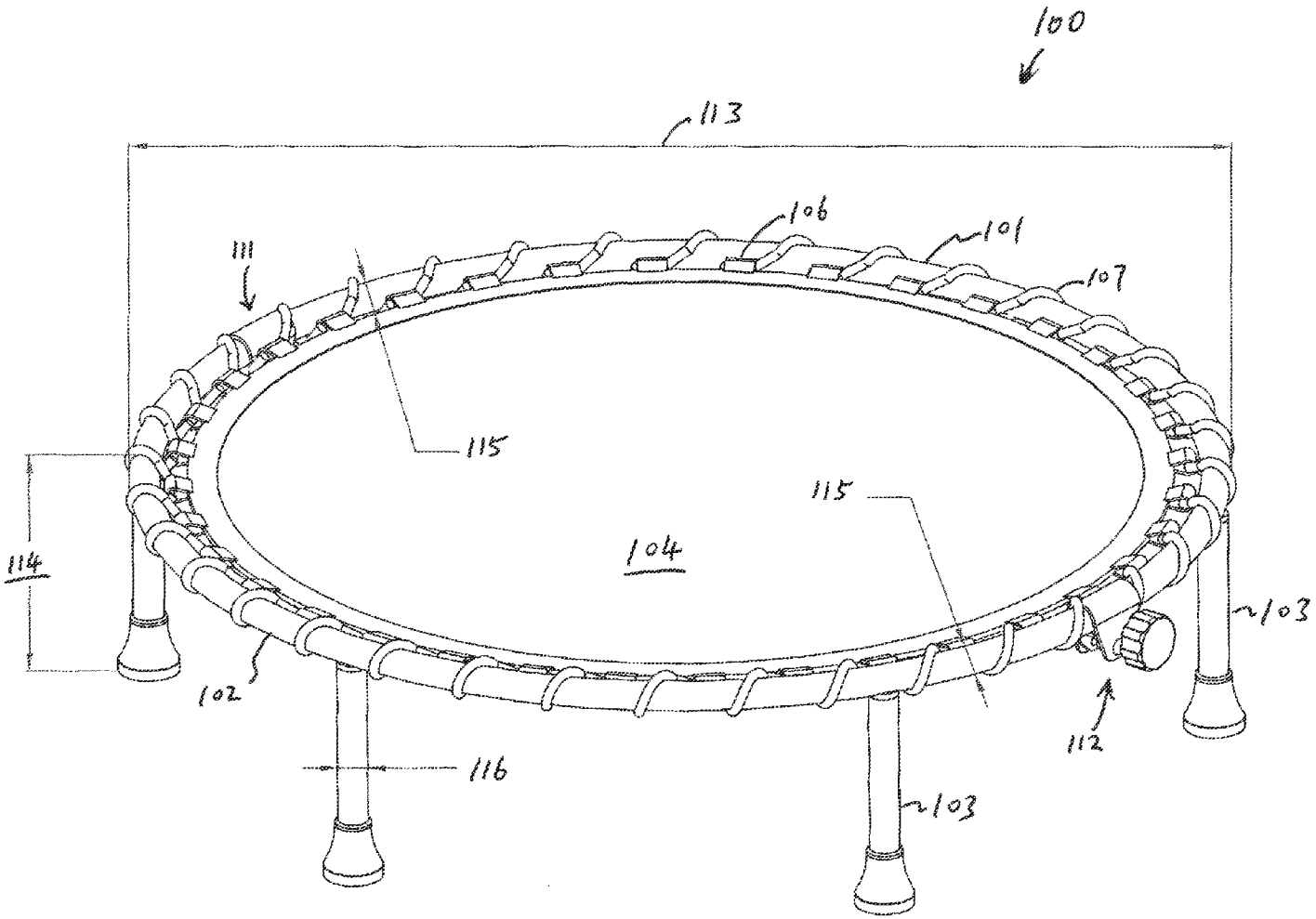

FIGS. 1A-1B show a perspective view of a trampoline device according to one embodiment of the invention. Referring to FIGS. 1A-1B, trampoline device 100 includes a tubular frame having first section 101 and second section 102 coupled to each other via a pair of frame hinges 111-112. In this embodiment, the tubular frame is formed in a substantially circular ring. In one embodiment, each of first section 101 and second section 102 of the tubular frame may be formed using a steel rod or steel tube (or any other strong enough material, such as aluminum alloy, fiber glass, etc.) molded or bent into a half circular ring. Note that in this embodiment, first section 101 and second section 102 of the tubular frame are shown and described in a substantially half circular shape. However, other shapes, such as rectangular, square, or oval shapes, may also be utilized.

In one embodiment, trampoline device 100 further includes a strong fabric or cloth 104 (e.g., canvas) stretched and tied to first section 101 and second section 102 of the tubular frame to form a bouncing mat or bouncing bed (also referred to as a trampoline mat or trampoline bed). The shapes of fabric 104 may conform to the shape of the tubular frame. In this embodiment, fabric 104 is in a circular shape with a diameter slightly less than the diameters of the tubular frame, such that fabric 104 can fit within interior edges of first section 101 and second section 102 of the tubular frame without being stretched over or covering the tubular frame.

In addition, trampoline device 100 further includes a set of at least three support members or legs 103 distributed substantially evenly along a perimeter of the tubular frame to provide support to first section 101 and second section 102 of the tubular frame. In one embodiment, each of legs 103 is mounted on first section 101 or second section 102 of the tubular frame substantially perpendicular to a cross plane of the tubular frame. Similarly to first tubular frame 101 and second tubular frame 102, support members 103 may be in a tubular shape and made of strong or hard enough material (e.g., steel tube, fiber glass) that can support the weight of a typical user. In one embodiment, each of support members 103 is made of a steel tube or steel rod. In one embodiment, an upper end of each of legs 103 can be attached to or detached from the tubular frame by screwing the leg onto or unscrewing the leg from the tubular frame. A lower end of each leg may be covered by a cap such as caps 132. Caps 132 may be made of non-slippery material such as tuber to provide anti-slippery friction against a support platform (e.g., floor) or prevent legs 103 from scratching the support platform.

In one embodiment, trampoline device 100 further includes an array of hooks or belt loops disposed substantially evenly on an edge 105 of fabric 104, such as hooks or mesh belt loops 106. The color of the edge portion 105 of fabric 104 may be different than the color of the rest of fabric 104 to provide an indication of the edge, for example, for safety reasons. Edge 105 may use an extra thickness of fabric to provide additional strength or enforcement for belt loops 106 and string 107 to pull fabric 104 outwardly to form a tension surface. Trampoline device 101 further includes a string or rope 107 inserted or traveling through an opening of each of hooks or belt loop 106. The size or diameter of fabric 104 is slightly smaller than a diameter of a cross plane of the tubular frame. String or rope 107 is configured to wrap around first section 101 and second section 102 of the tubular frame, while stretching and pulling fabric 104 outwardly towards the tubular frame 101 via hooks 106 to form a tension surface. Hooks or mesh belt loops 106 may be made of a wear resistant and heat tolerance material. Hooks or mesh belt loops 106 may be attached to edge 105 of fabric 104 using machine sewing. String 107 may include a rubber tube or rubber string enclosed by a wear resistant and heat tolerance material to form a tension rope. The tension rope provides resistance and stores energy when a user steps onto fabric 104. Unlike a conventional trampoline, the configuration as shown in FIGS. 1A-1B does not use any metal springs or coils, which is more expensive, heavy, and easier to break or dislocate. Rather, tension rope 107 is utilized to tie fabric 104 to first section 101 and second section 102 of the tubular frame, which is safer, more reliable, and easier to disassemble.

Figure 2:
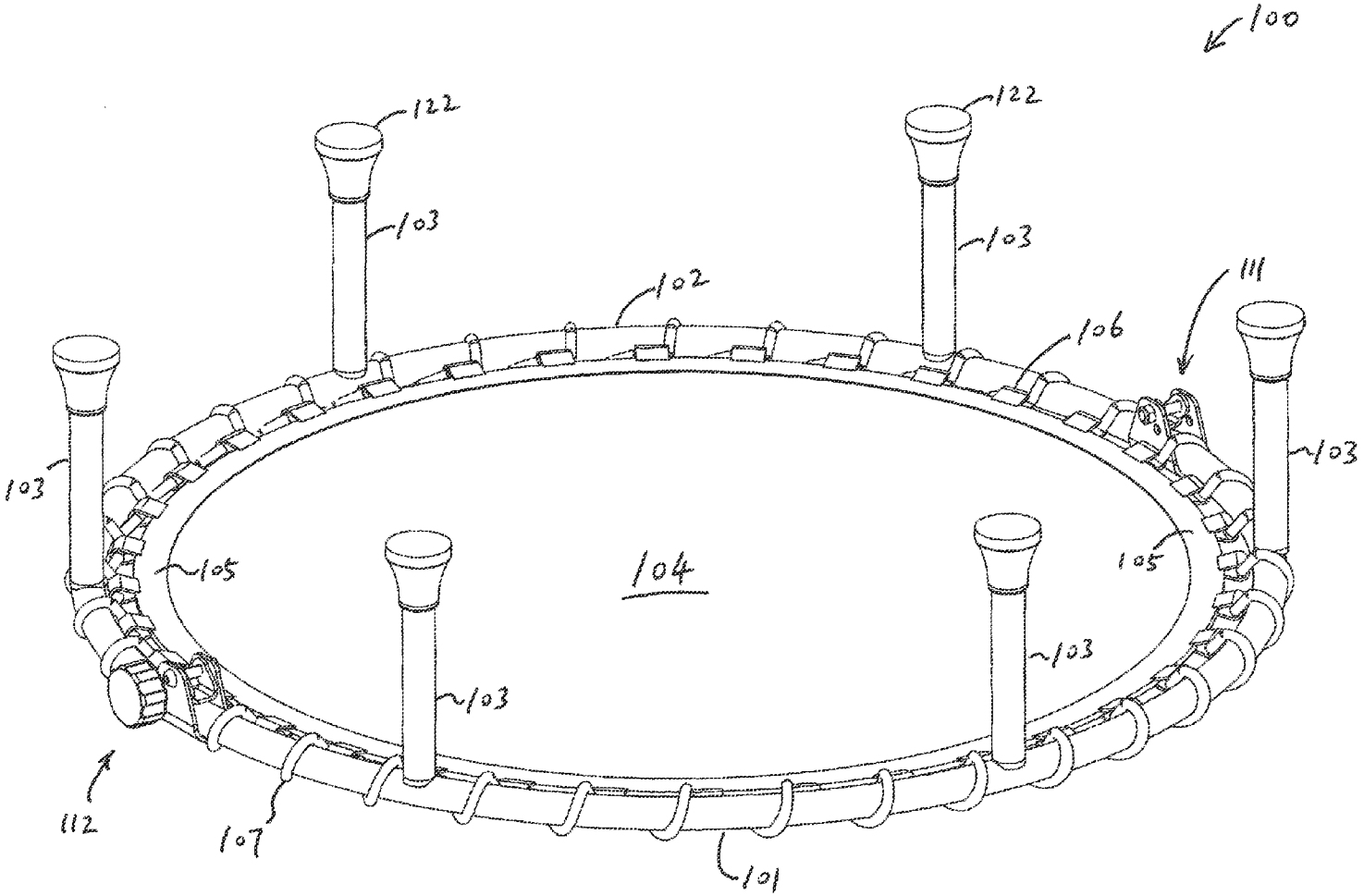
FIG. 2 shows a bottom perspective view of a trampoline according to one embodiment of the invention.
Figure 3:
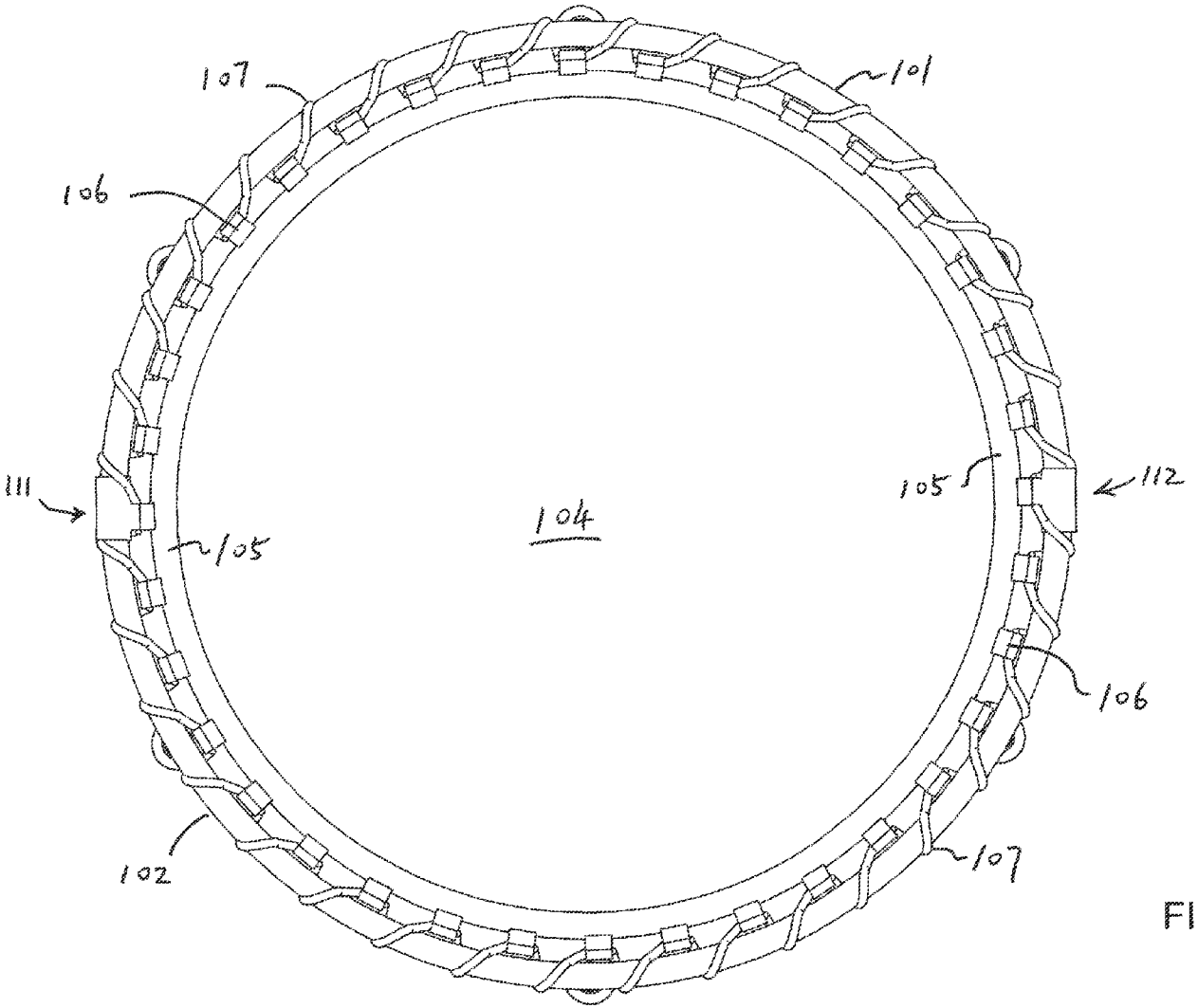
FIG. 3 shows a top view of a trampoline device according to one embodiment of the invention.
Figure 4A:
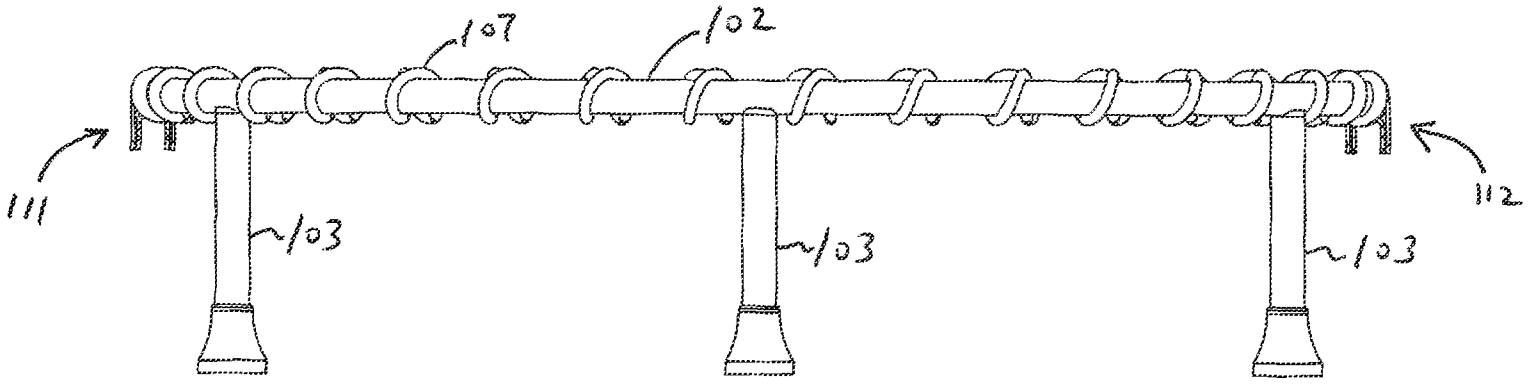
FIGS. 4A-4B show side views of a trampoline device according to one embodiment of the invention.
Figure 4B:
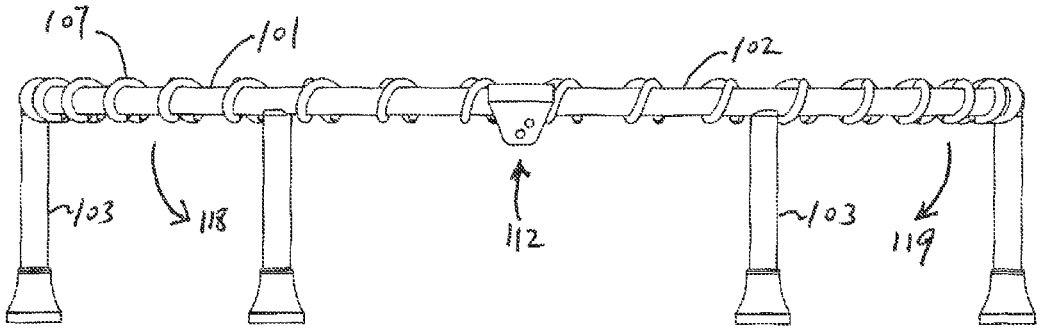
Figure 5:
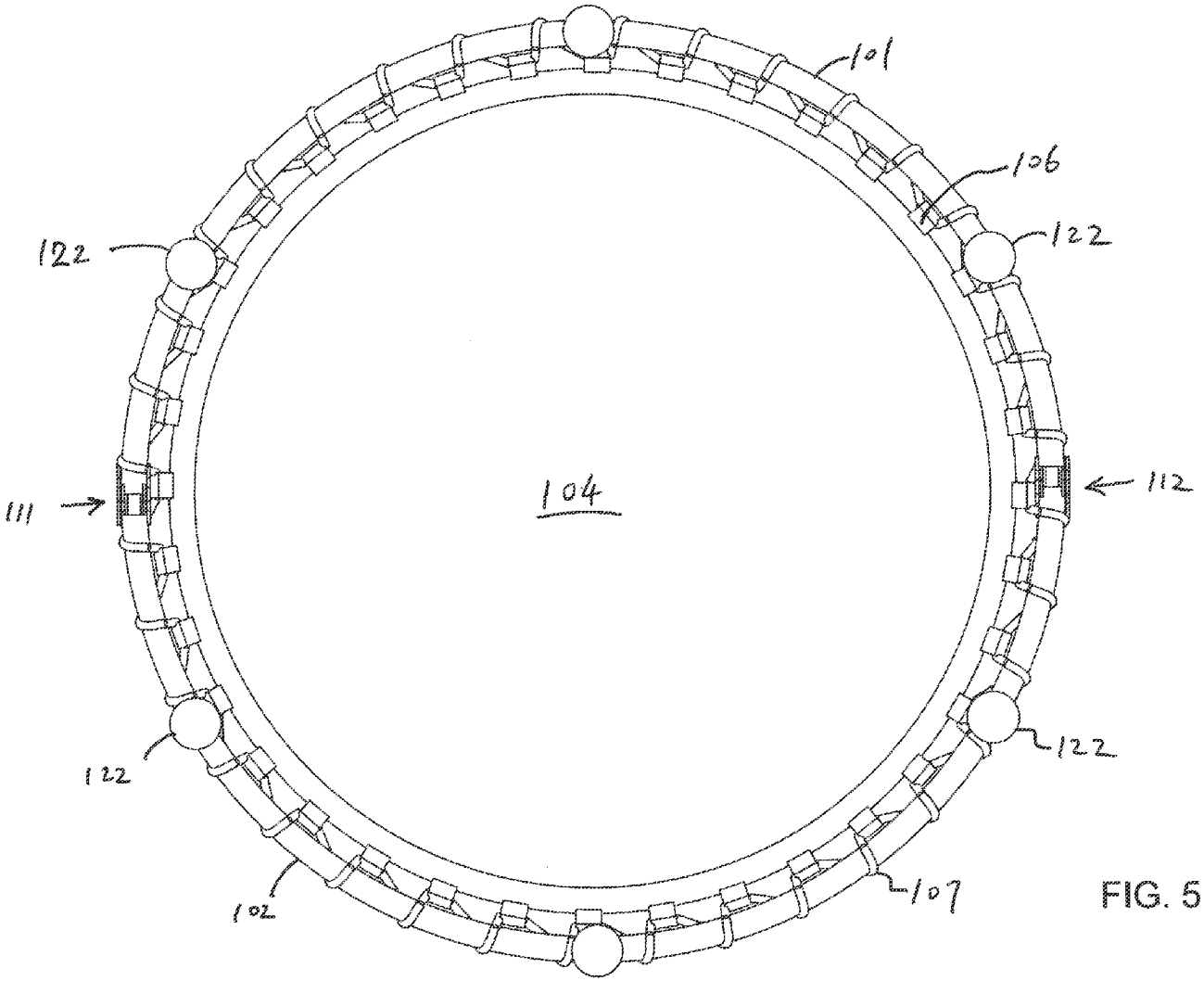
FIG. 5 shows a bottom view of a trampoline device according to one embodiment of the invention.

Referring now to FIG. 1B, according to one embodiment, diameter 113 of the tubular frame formed by first section 101 and second section 102 via pair of frame hinges 111-112 is approximately 36 inches, 38 inches, or 40 inches. The height 114 of trampoline device 100 is approximately 8 inches. Diameter 115 of first section 101 and second section 102 of the tubular frame is approximately 1 inch. Diameter 116 of each of legs 103 is approximately 1 inch. However, other dimensions or form factors may also be applicable. FIG. 2 shows a bottom perspective view of a trampoline according to one embodiment of the invention. FIG. 3 shows a top view of a trampoline device according to one embodiment of the invention. FIGS. 4A-4B show side views of a trampoline device according to one embodiment of the invention. FIG. 5 shows a bottom view of a trampoline device according to one embodiment of the invention.

According to one embodiment, via the pair of frame hinges 111-112, after detaching legs 103 from first section 101 and second section 102 of the tubular frame, first section 101 and second section 102 can be folded towards to each other. Referring to FIG. 4B, which is a side view of a trampoline device, first section 101 and second section 102 can be folded downwardly as indicated in directions 118-119 respectively via hinge 112 and hinge 111 (not shown).

Figure 6:
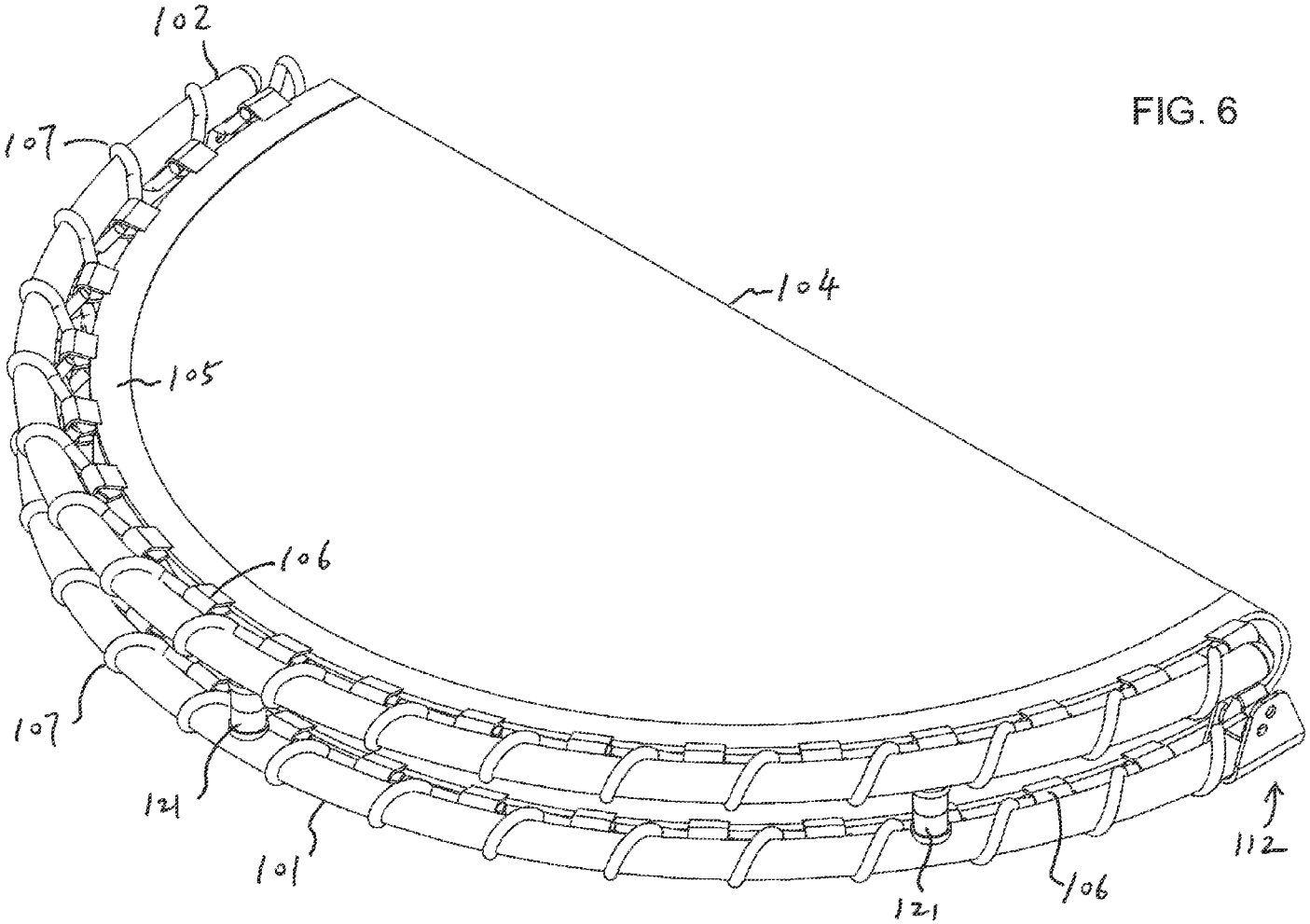
FIG. 6 shows a perspective view of a trampoline device in a folded position according to one embodiment of the invention.

FIG. 6 shows a perspective view of a trampoline device in a folded position according to one embodiment of the invention. Referring to FIG. 6, according to one embodiment, each of first section 101 and second section 102 of the tubular frame includes one or more leg connectors or sockets 121 fixedly attached thereon. A leg connector or socket 121 allows a leg such as leg 102 to be screwed onto or off. A leg connector or socket may include a threaded hole to allow a screw of a leg to be screwed on and off. After the legs are detached, leg connectors or sockets may serve as separators to prevent first section 101 and second section 102 from contacting or scratching each other. When the trampoline device is in a folded position as shown in FIG. 6, the trampoline device has been transformed into a substantially half pie shape, which is easier for storage or transportation. In the folded configuration the top surface of fabric 104 (e.g., the surface facing a user) becomes an exterior surface, while the bottom surface of fabric 104 (e.g., the surface facing the support platform or the floor and away from the user) becomes an interior surface.

Figure 7A:
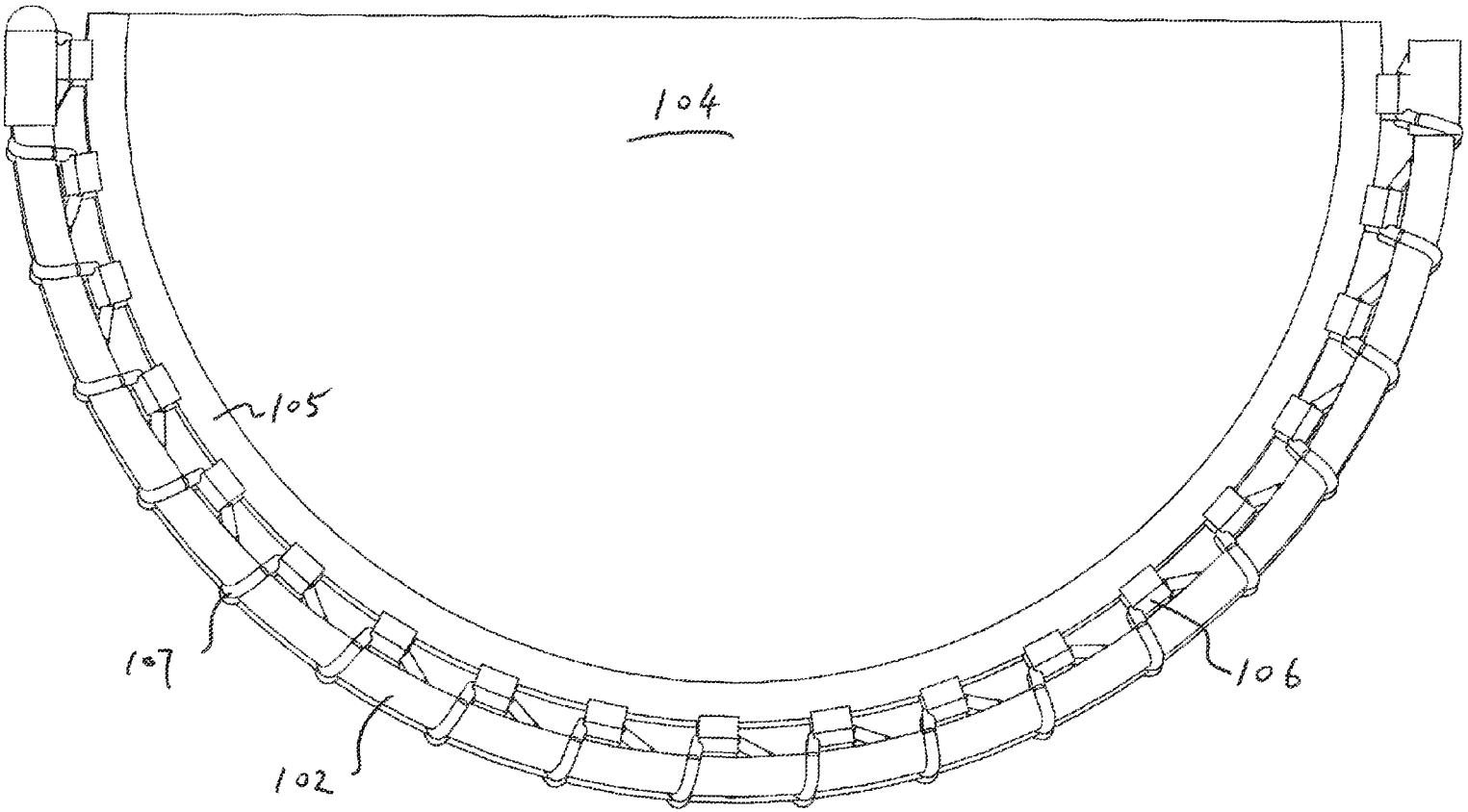
FIG. 7A shows a top view of a trampoline device in a folded position according to one embodiment of the invention.
Figure 7B:
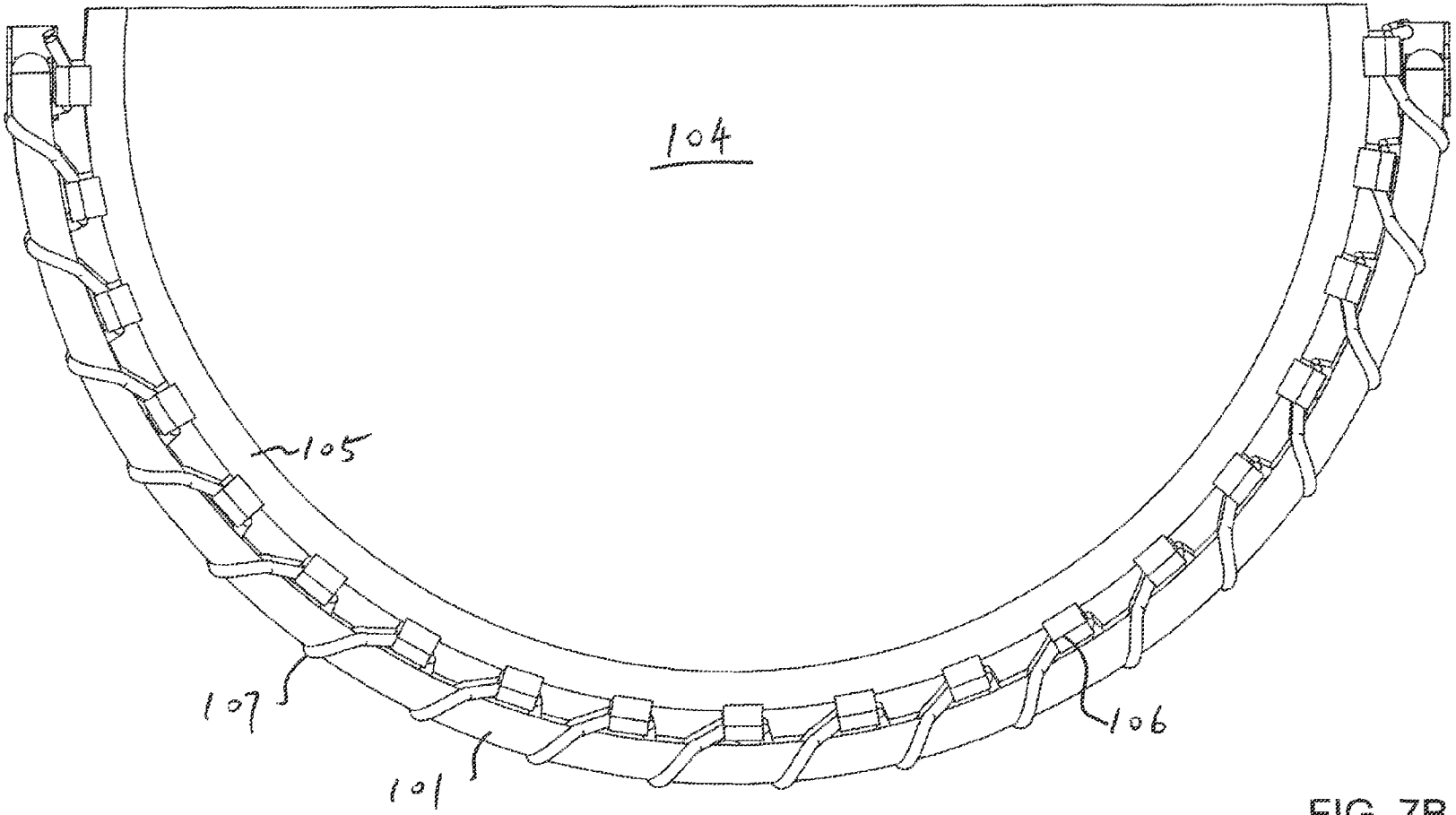
FIG. 7B shows a bottom view of a trampoline device in a folded position according to one embodiment of the invention.
Figure 8A:
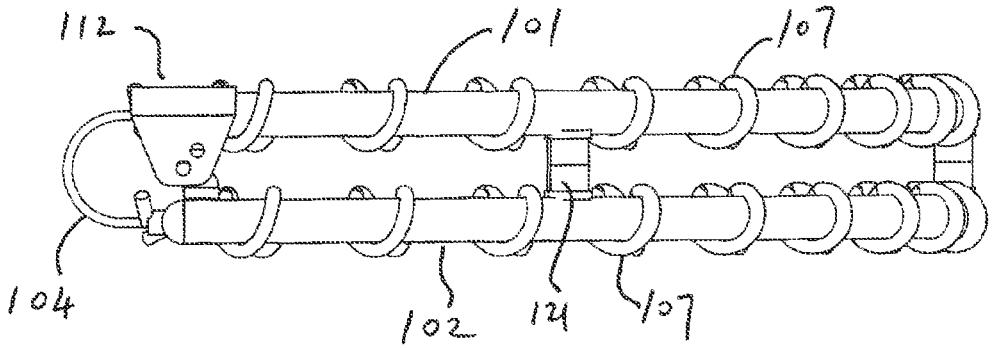
FIGS. 8A-8C show side views of a trampoline device in a folded position according to one embodiment of the invention.
Figure 8B:
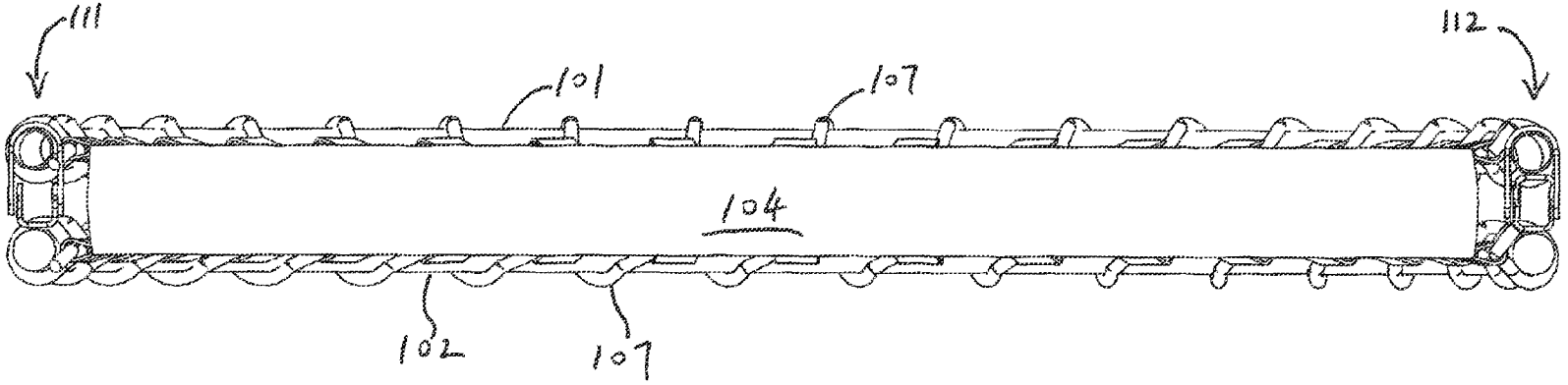
Figure 8C:
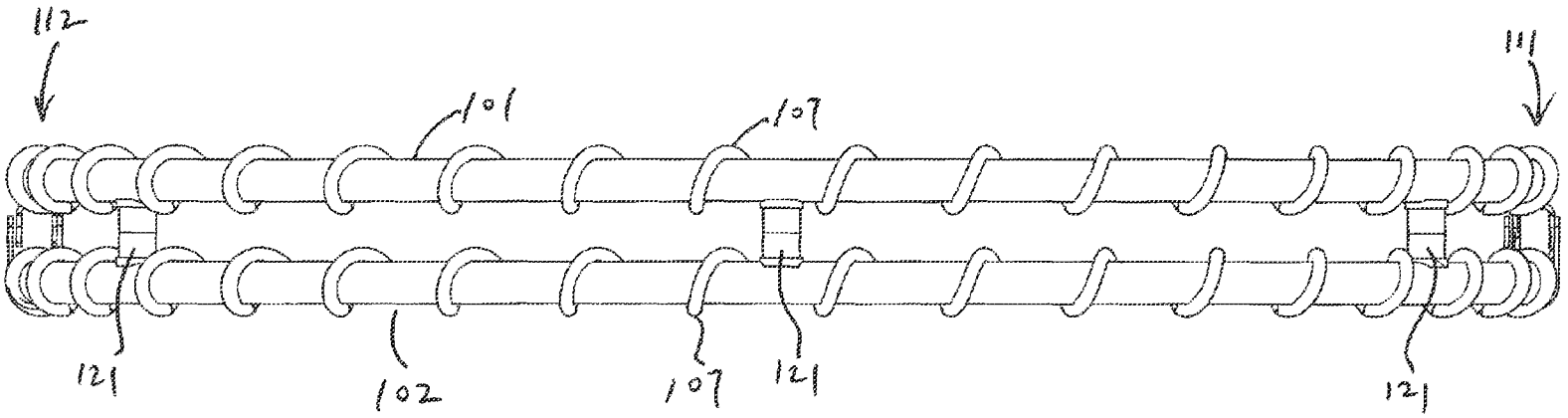
Figure 9A:
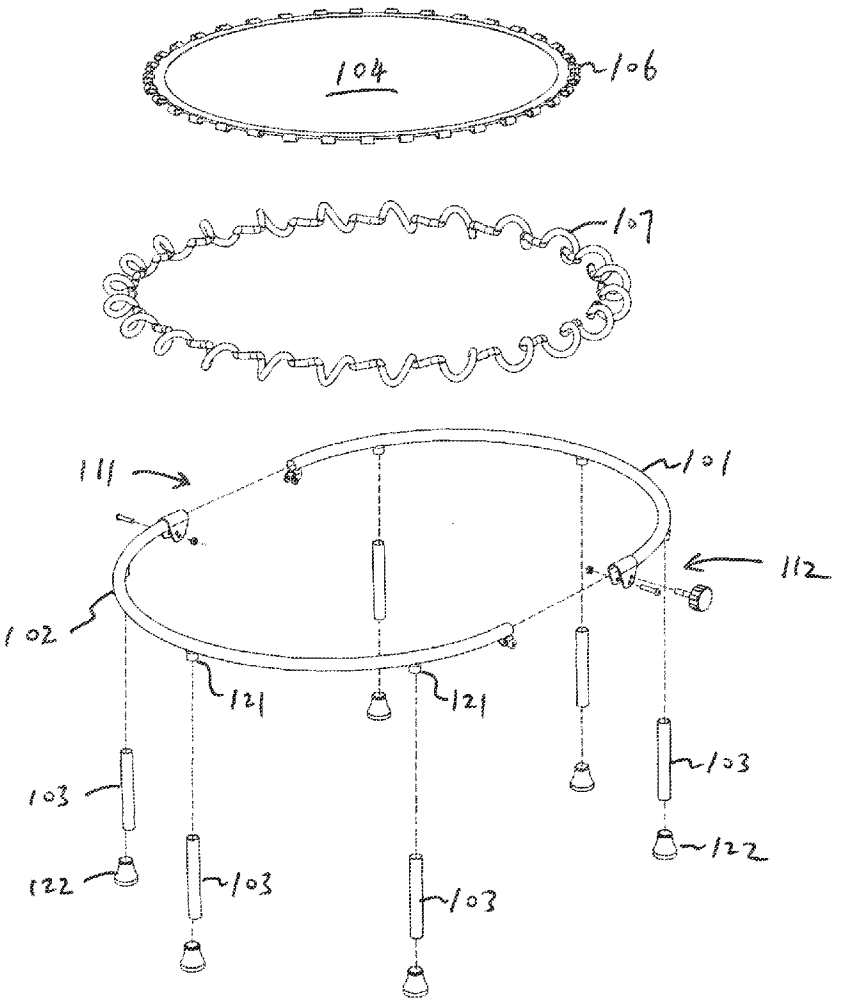
FIGS. 9A-9B are explosive views of a trampoline device according to one embodiment of the invention.
Figure 9B:
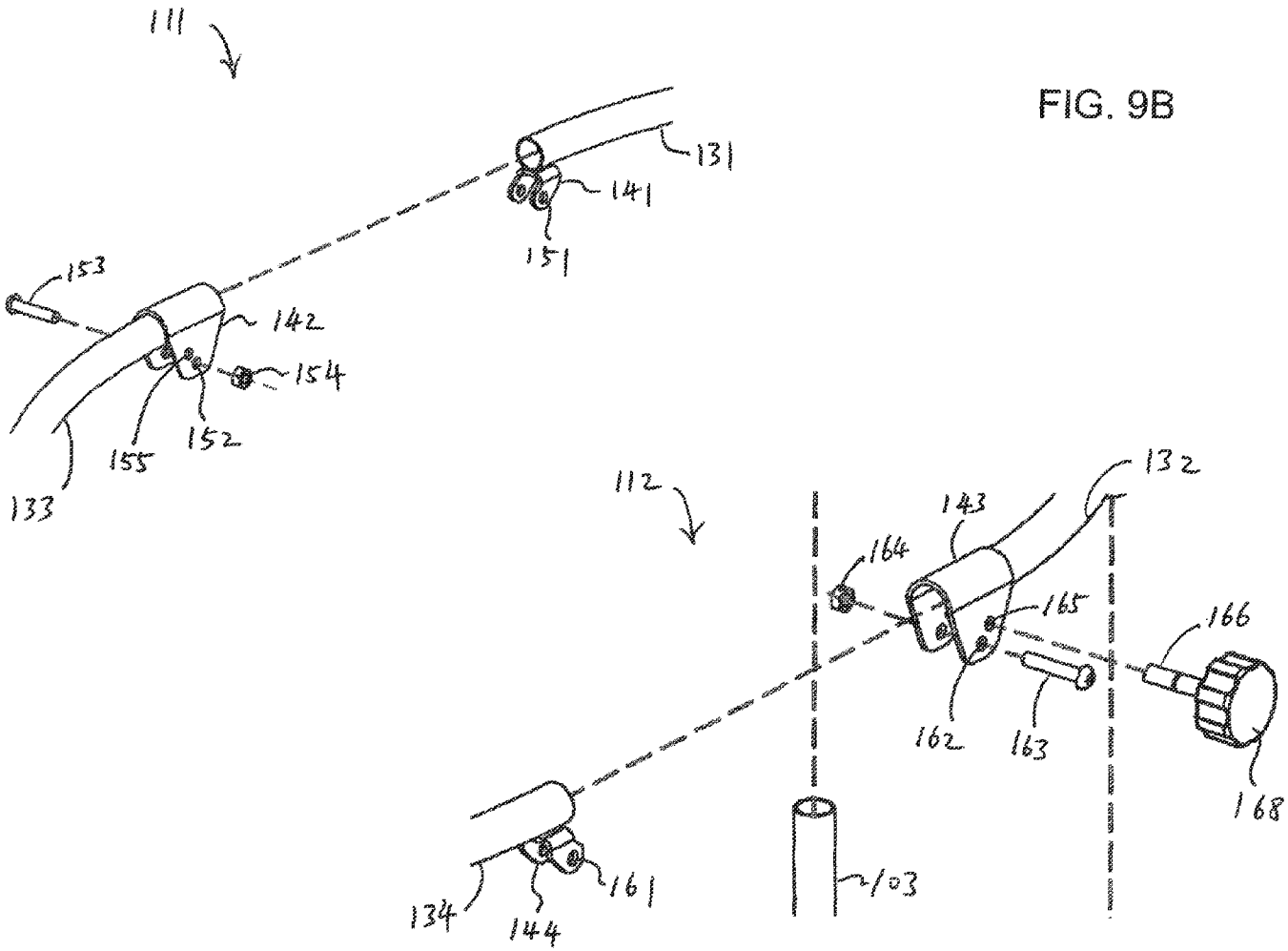

FIG. 7A shows a top view of a trampoline device in a folded position according to one embodiment of the invention. FIG. 7B shows a bottom view of a trampoline device in a folded position according to one embodiment of the invention. FIGS. 8A-8C show side views of a trampoline device in a folded position according to one embodiment of the invention. FIGS. 9A-9B are explosive views of a trampoline device according to one embodiment of the invention.

Referring to FIG. 9B, which is an enlarged explosive view from the one as shown in FIG. 9A, first section 101 of a tubular frame includes first end 131 and second end 132 pivotally coupled to each other via hinge 111. Similarly, second section 102 of the tubular frame includes first end 133 and second end 134 pivotally coupled to each other via hinge 112. As a result, first section 101 and second section 102 can be rotated with respect to each other to configure a trampoline device in an unfolded position or a folded position as described above.

In one embodiment, first end 131 of first section 101 includes mounting bracket 141 fixedly attached thereon, where mounting bracket 141 includes a mounting hole for mounting purposes. Similarly, first end 133 of second section 102 includes mounting bracket 142, where mounting bracket 142 includes a corresponding mounting hole. The mounting hole of mounting bracket 141 attached to first end 131 of first section 101 can be aligned with the mounting hole of mounting bracket 142 attached to first send 133 of second section 102 to allow a rod inserted therethrough and tighten with a nut.

Similarly, second end 132 of first section 101 includes mounting bracket 143 fixedly attached thereon, where mounting bracket 143 includes a mounting hole for mounting purposes. Similarly, second end 134 of second section 102 includes mounting bracket 144, where mounting bracket 144 includes a corresponding mounting hole. The mounting hole of mounting bracket 143 attached to second end 132 of first section 101 can be aligned with the mounting hole of mounting bracket 144 attached to second send 134 of second section 102 to allow a rod inserted therethrough and tighten with a nut.

In this embodiment as shown in FIG. 9B, mounting bracket 141 is a U-shape mounting bracket having a pair of mounting holes 151 disposed on the fins or wings of U-shape bracket 141. In this example, the exterior surface of the bottom of the U-shape bracket 141 is fixedly attached to first end 131, for example, by melding or soldering. Similarly, mounting bracket 142 is a U-shape mounting bracket having a pair of mounting holes 152 disposed on the fins or wings of U-shape bracket 142. In this example, the bottom of the U-shape is fixedly attached to first end 133, where the shape of the bottom or valley of the U-shape is substantially conformed to an exterior shape of first end 133 of second section 102 of the tubular frame. For example, first end 133 is melded or soldered within a valley of the U-shape bracket 142.

In one embodiment, mounting bracket 141 is positioned within mounting bracket 142 to align mounting holes 151 with mounting holes 152. The aligned mounting holes 151-152 allow a hinge rod 153 to be inserted therein and tightened with nut 154 to form hinge 111. As a result, first end 131 of first section 101 and first end 133 of second section 102 can be folded by rotate downwardly via hinge 111. According to one embodiment, mounting bracket 142 further includes a pair of tightening holes 155 to allow a tightening pin, such as tightening pin 166, to be inserted therethrough to tighten or lock first end 131 of first section 101 and first end 133 of second section 102 in an unfolded position.

According to one embodiment, mounting bracket 144 is a U-shape mounting bracket having a pair of mounting holes 161 disposed on the fins or wings of U-shape bracket 144. In this example, the exterior surface of the bottom of the U-shape bracket 144 is fixedly attached to second end 134, for example, by melding or soldering. Similarly, mounting bracket 143 is a U-shape mounting bracket having a pair of mounting holes 162 disposed on the fins or wings of U-shape bracket 143. In this example, the bottom of the U-shape is fixedly attached to second end 132, where the shape of the bottom or valley of the U-shape is substantially conformed to an exterior shape of second end 132 of first section 101 of the tubular frame. For example, second end 132 is melded or soldered within a valley of the U-shape bracket 143.

In one embodiment, mounting bracket 144 is positioned within mounting bracket 143 to align mounting holes 161 with mounting holes 162. The aligned mounting holes 161-162 allow a hinge rod 163 to be inserted therein and tightened with nut 164 to form hinge 112. As a result, second end 132 of first section 101 and second end 134 of second section 102 can be folded by rotate downwardly via hinge 112. According to one embodiment, mounting bracket 162 further includes a pair of tightening holes 165 to allow tightening pin 166 to be inserted therethrough to tighten or lock second end 132 of first section 101 and second end 134 of second section 102 in an unfolded position. Tightening pin 166 may include some threads disposed on its tip and knob 168 on the other end to allow a user to hold and rotate tightening pin 166 to tighten or loosen mounting brackets 143-144.

According to another embodiment, in addition to foldable sections 101-102 of the tubular frame, each of legs 103 can also be foldable. Each of legs 103 can be folded inwardly towards the center of the tubular frame without being detached from the tubular frame. Each of legs 103 is coupled to the tubular frame via a respective leg hinge that allows the leg to be folded inwardly without detaching the leg.

Figure 10:
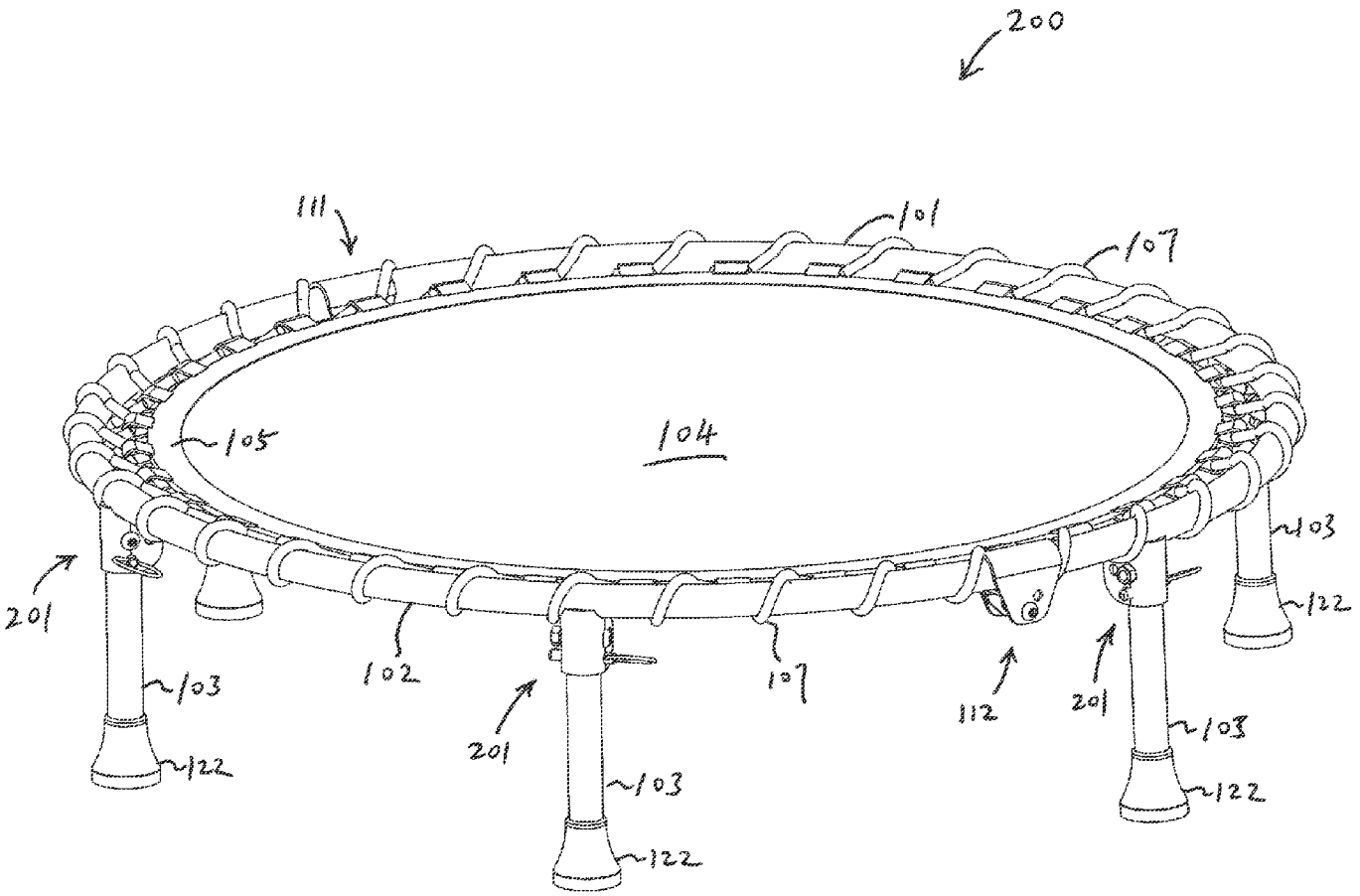
FIG. 10 is a perspective view of a foldable trampoline according to another embodiment of the invention.
Figure 11A:
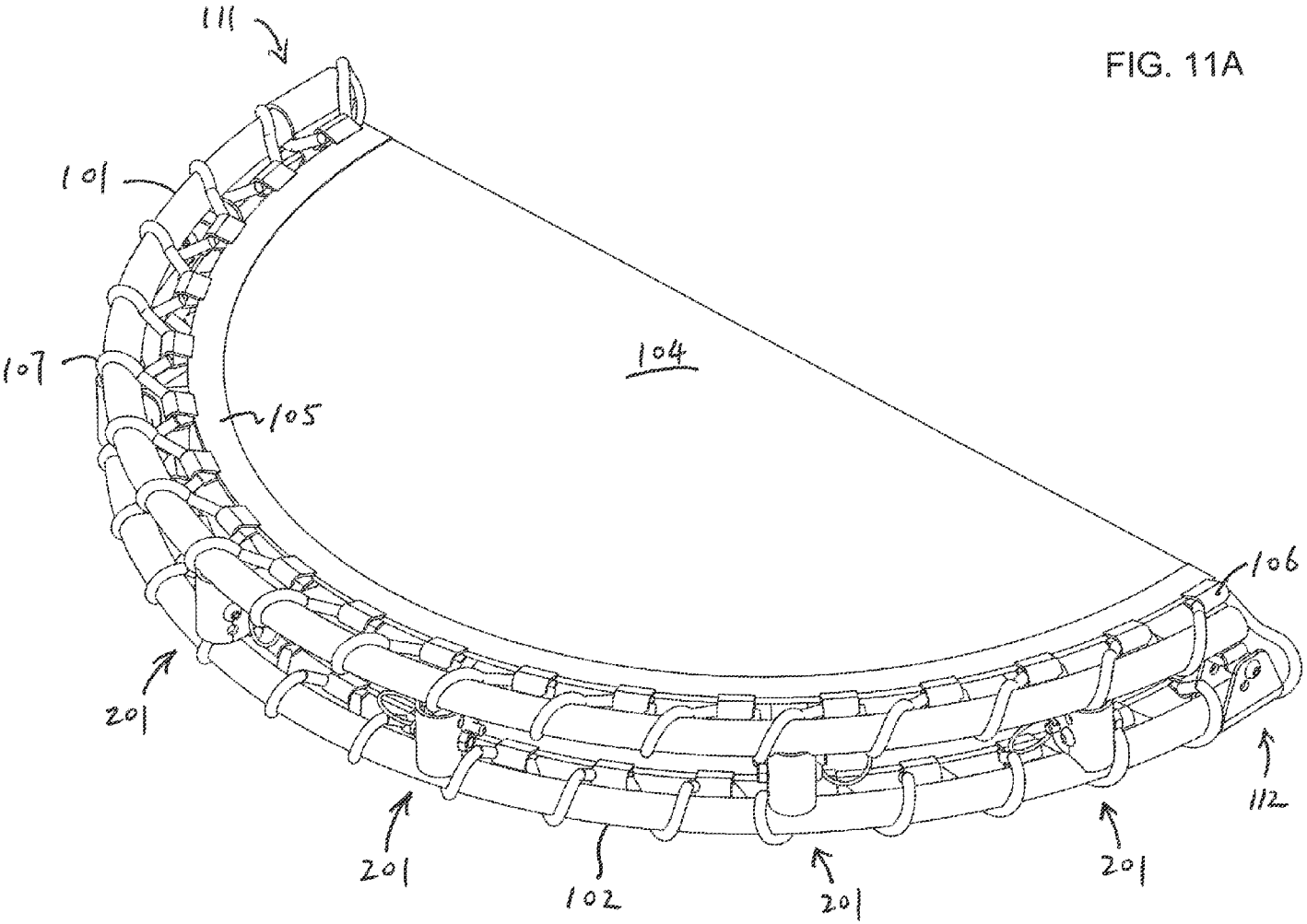
FIGS. 11A-11B show perspective views of a trampoline device in a folded position according to one embodiment of the invention.
Figure 11B:
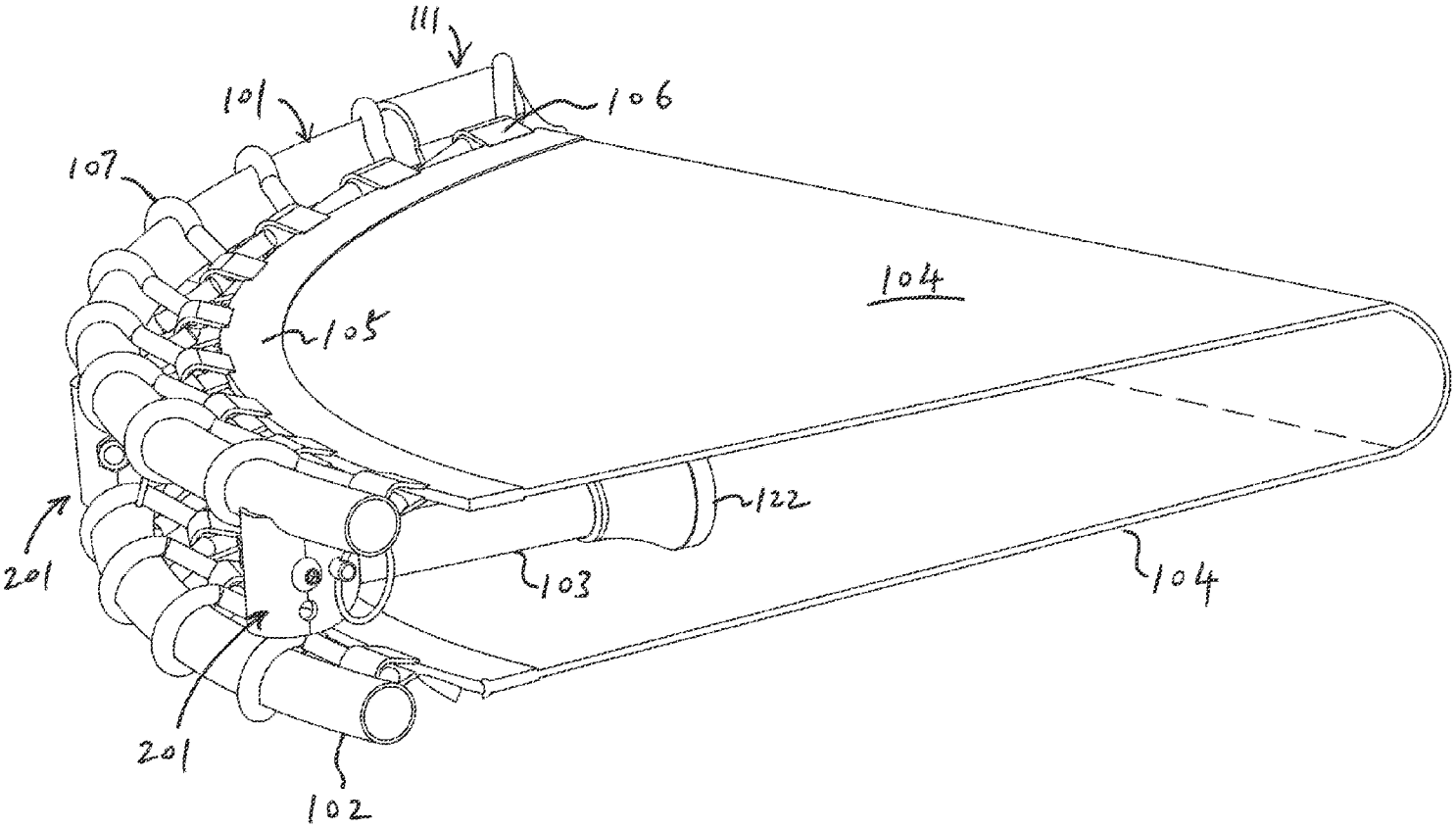
Figure 16:
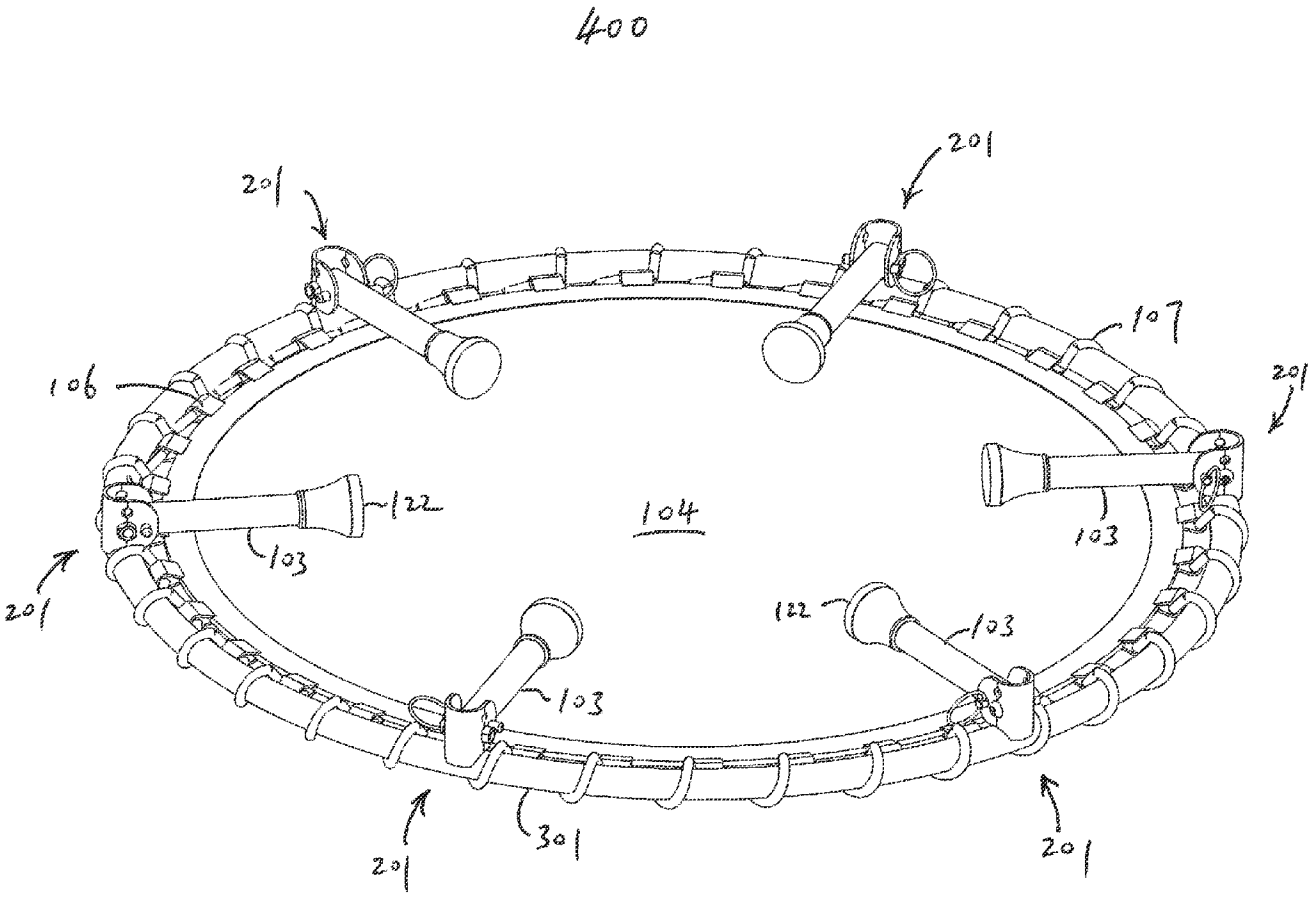
FIG. 16 shows a bottom perspective view of a trampoline device according one embodiment of the invention.

FIG. 10 is a perspective view of a foldable trampoline according to another embodiment of the invention. Referring to FIG. 10, similar to the foldable trampoline as shown in FIGS. 1A-1B, trampoline device 200 includes a tubular frame having first section 101 and second section 102 coupled to each other via a pair of frame hinges 111-112, as well as other components as described above, which are illustrated with the same reference numbers. In addition, according to one embodiment, each of legs 103 is coupled to one of the first section 101 and second section 102 via a respective leg hinge 201. Leg hinge 201 is fixedly attached to the tubular frame to allow leg 103 to be folded inwardly without being detached, for example, as shown in FIG. 16. When leg 103 is in an unfolded position, an elongate axis of leg 103 is substantially perpendicular to a cross plane of the tubular frame. When leg 103 is in a folded position, the elongate axis of leg 103 is substantially in parallel with the cross plane of the tubular frame as shown in FIG. 16. FIGS. 11A-11B show perspective views of a trampoline device in a folded position according to one embodiment of the invention. As shown in FIG. 11B, which is a cross-perspective view of the trampoline device, leg 103 is folded and sandwiched by the folded sections 101-102 with flexible fabric 104 attached thereon.

Figure 12A:
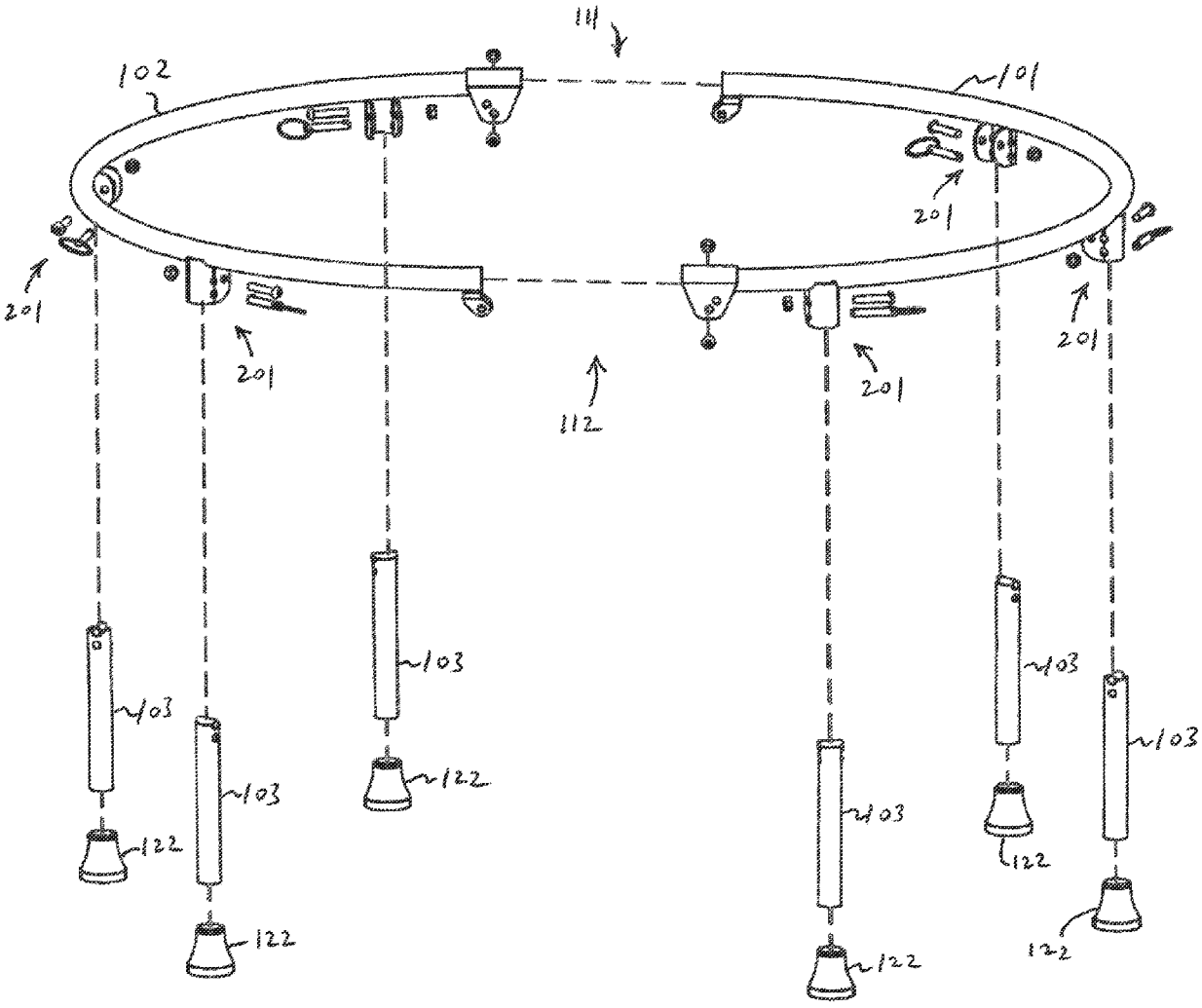
FIGS. 12A-12B are explosive views of a foldable trampoline device according to one embodiment of the invention.
Figure 12B:
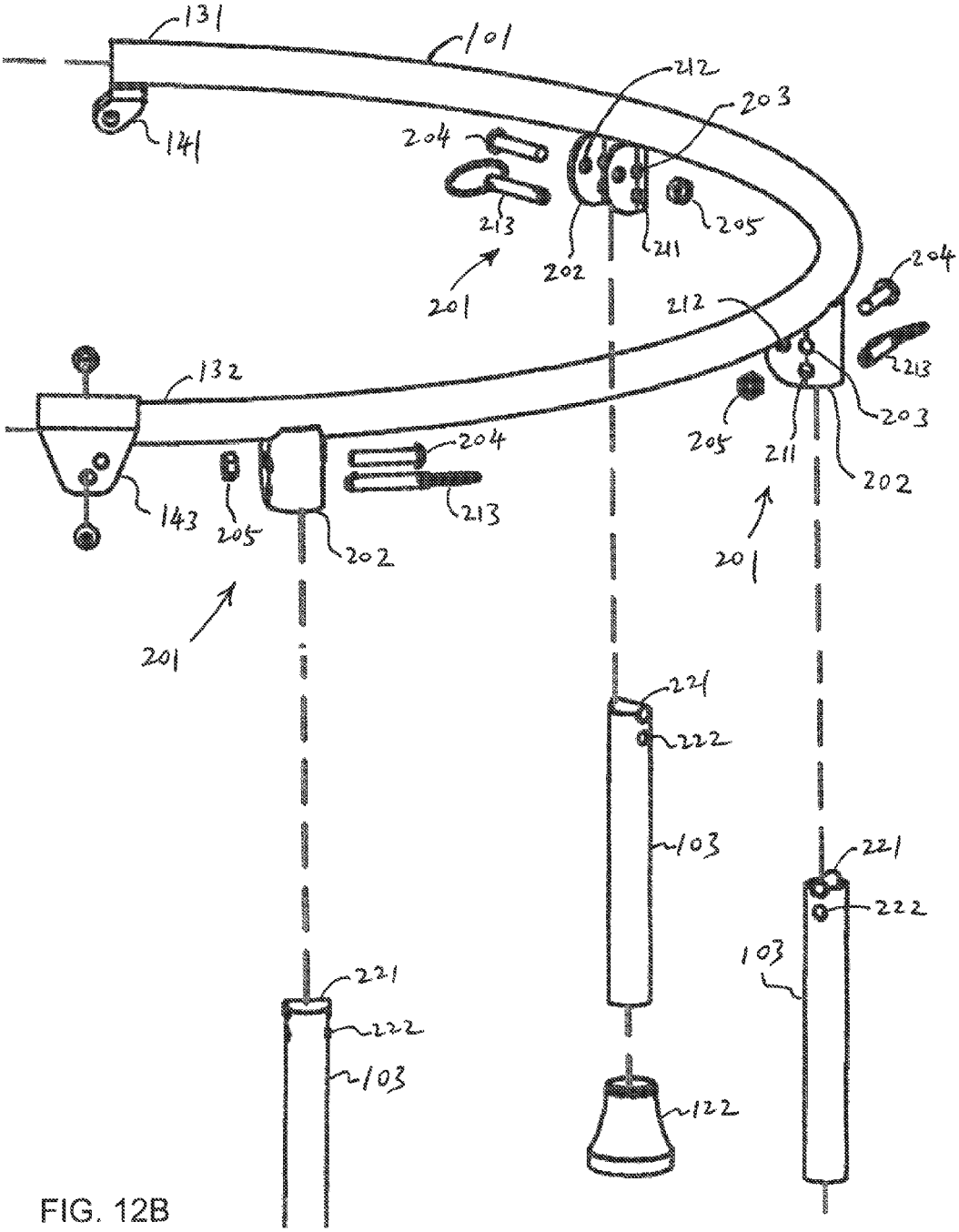

FIGS. 12A-12B are explosive views of a foldable trampoline device according to one embodiment of the invention. Referring to FIG. 12A, as described above, a tubular frame of a trampoline device includes first section 101 and second section 102 coupled to each other via a pair of frame hinges 111-112. Each of legs 103 is rotatably or pivotally attached to the tubular frame via a respective leg hinge 121. Each of leg hinges 121 is fixedly attached underneath the tubular frame to allow leg 103 to be in either an unfolded position (e.g., perpendicular or vertically to a cross plane of the tubular frame as shown in FIG. 10) or a folded position (e.g., horizontally in parallel with the cross plane of the tubular frame as shown in FIG. 16).

Referring now to FIG. 12B, which is an enlarged explosive view from FIG. 12A, each of leg hinge 201 includes a mounting bracket 202. Mounting bracket 202 includes hinge hole 203. An upper end of leg 103 includes an elongate tube 221 having an opening or tunnel therethrough. Elongate tube 221 may be melded or soldered onto the upper end of leg 103. When the opening or tunnel of elongate tube 221 is aligned with hinge hole 203, a rod 204 can be inserted through the aligned hinge hole 203 and elongate tube 221 to form leg hinge 201. The tip of rod 204 may be threaded to allow a nut 205 to be screwed thereon to tighten the hinge. With leg hinge 201, leg 103 can be folded inwardly towards the center of the tubular frame.

In one embodiment, as shown in FIG. 12B, bracket 203 is a U-shape bracket having a valley that is substantially conformed to an exterior surface of leg 103 to allow leg 103 to be positioned or enclosed therein. Hinge hole 203 would include a pair of hinge holes to allow rod 204 inserted therethrough. In addition, bracket 203 further includes a first pair of locking holes 211 and a second pair of locking holes 212. Each leg 103 further includes a pair of locking holes 222 near the upper end of leg 103.

In one embodiment, when leg 103 is attached to bracket 202 by aligning tube 221 with hinge holes 203 with rod 204 inserted therein, locking holes 222 can be aligned with either locking holes 211 or locking holes 212 to allow locking pin 213 inserted therethrough to lock leg 103 in an unfolded or folded position. The axis of the elongate tube 221 is parallel with locking holes 222. In one embodiment, when leg 103 is in an unfolded position, the opening of tube 221 of leg 103 is aligned with hinge holes 203 of bracket 202, while locking holes 222 are aligned with locking holes 211 of bracket 202. When leg 103 is in a folded position, the opening of tube 221 of leg 103 is aligned with hinge holes 203 of bracket 202, while locking holes 222 are aligned with locking holes 212 of bracket 202.

Figure 13:
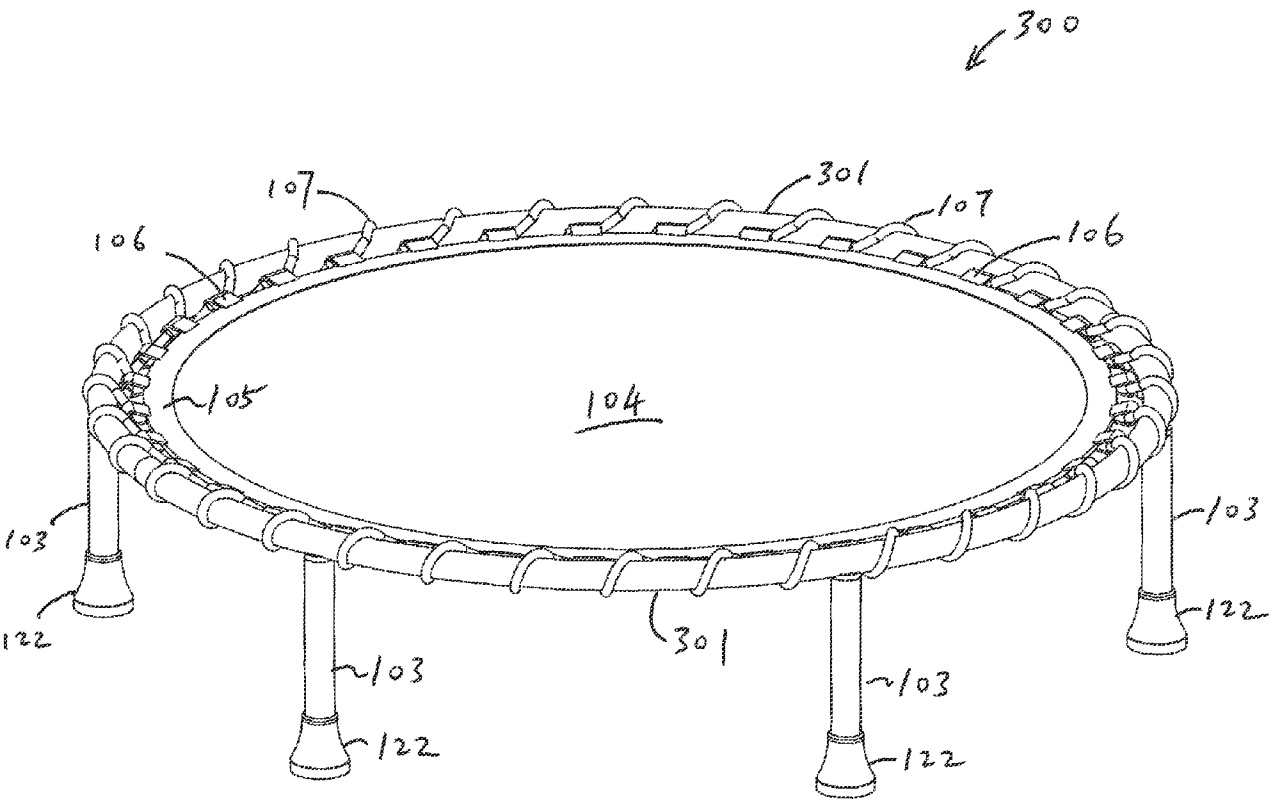
FIG. 13 shows a perspective view of a trampoline device using flexible fabric without using metal springs according one embodiment.
Figure 14:
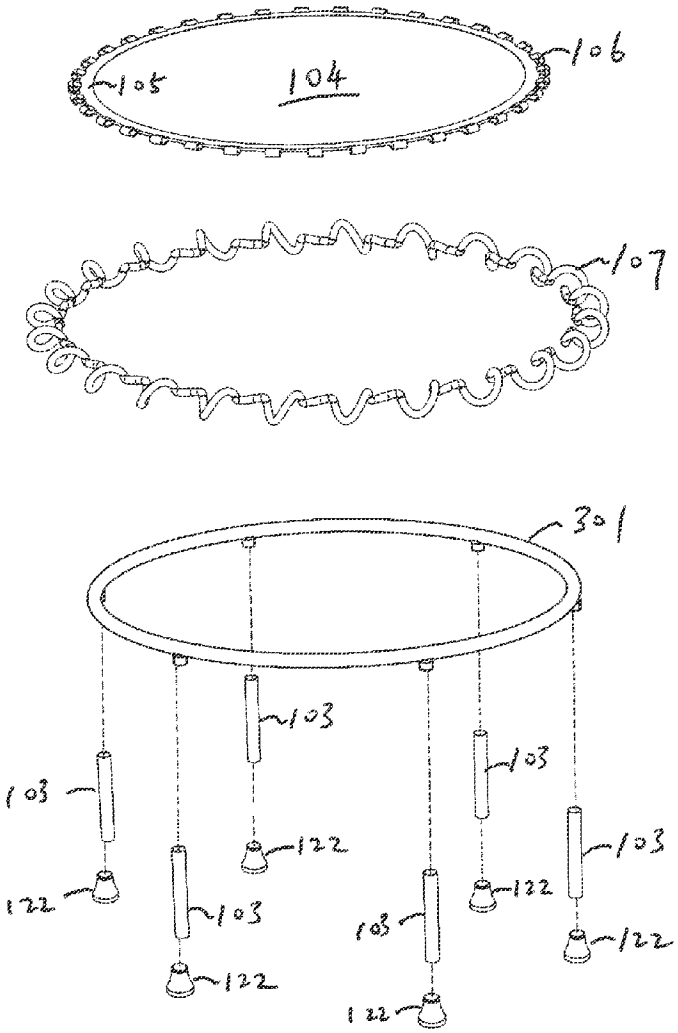
FIG. 14 shows an explosive view of a trampoline device using flexible fabric without using metal springs according one embodiment.

As described above, according to one embodiment, a trampoline device utilizes a flexible fabric with an array of belt loops disposed on an edge of the fabric and a rope or string to pull the belt loops to tie the fabric with the tubular frame, without using any metal springs, etc. FIG. 13 shows a perspective view of a trampoline device using flexible fabric without using metal springs according one embodiment. Referring to FIG. 13, trampoline device 300 includes tubular frame 301, which may be constructed similar to the tubular frame as described above (e.g., sections 101-102). The remaining components or parts that are identical or similar to those described above have been referenced by the same references. Thus, the description of the same reference numbers above can be equally applicable herein. In this embodiment, trampoline device 300 is not a foldable device. However, one of the advantages is that such device does not use the metal springs as required by a conventional trampoline device. FIG. 14 shows an explosive view of trampoline device as shown in FIG. 13.

Figure 15:
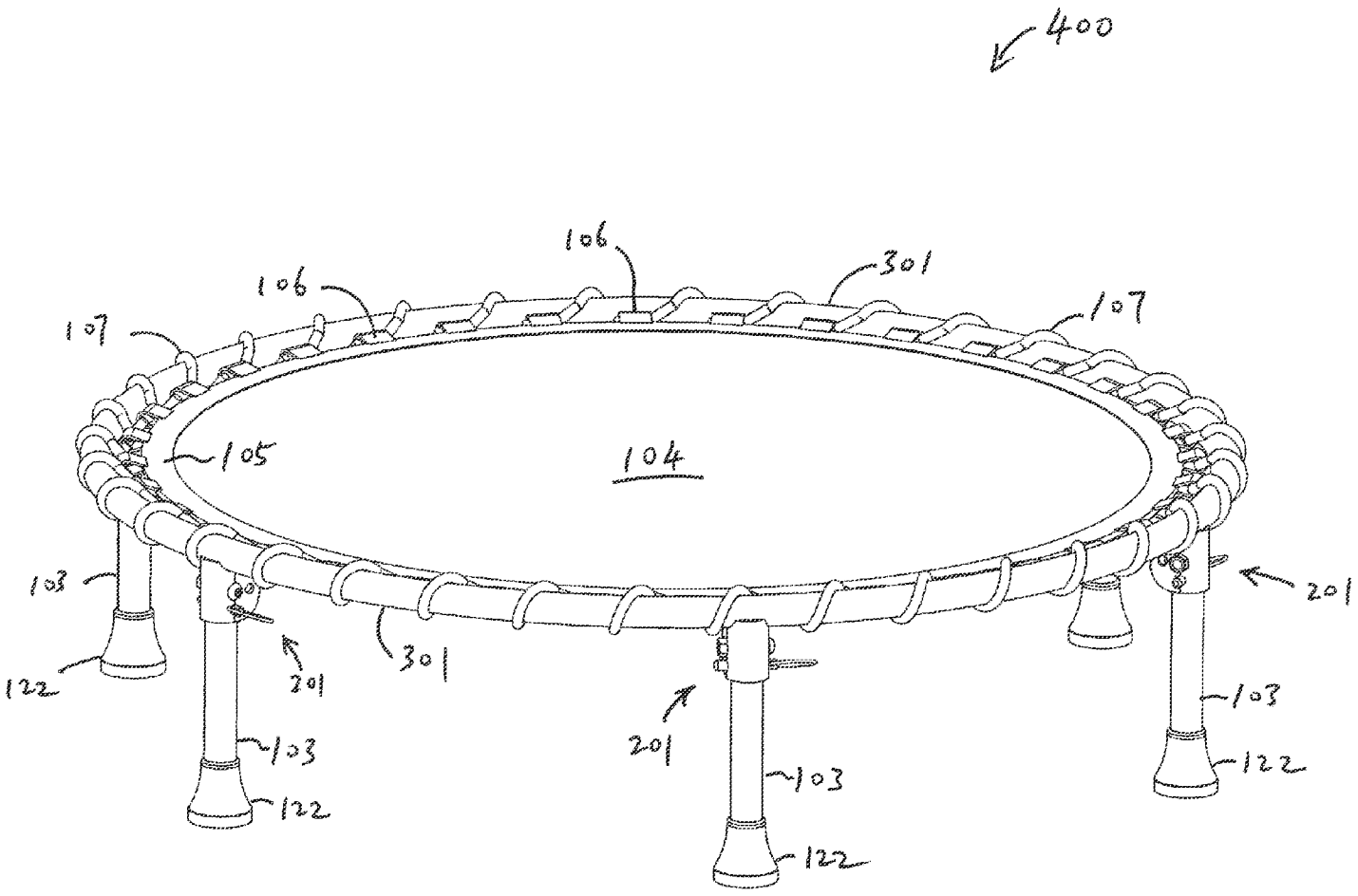
FIG. 15 shows a perspective view of a trampoline device according to another embodiment of the invention.
Figure 17:
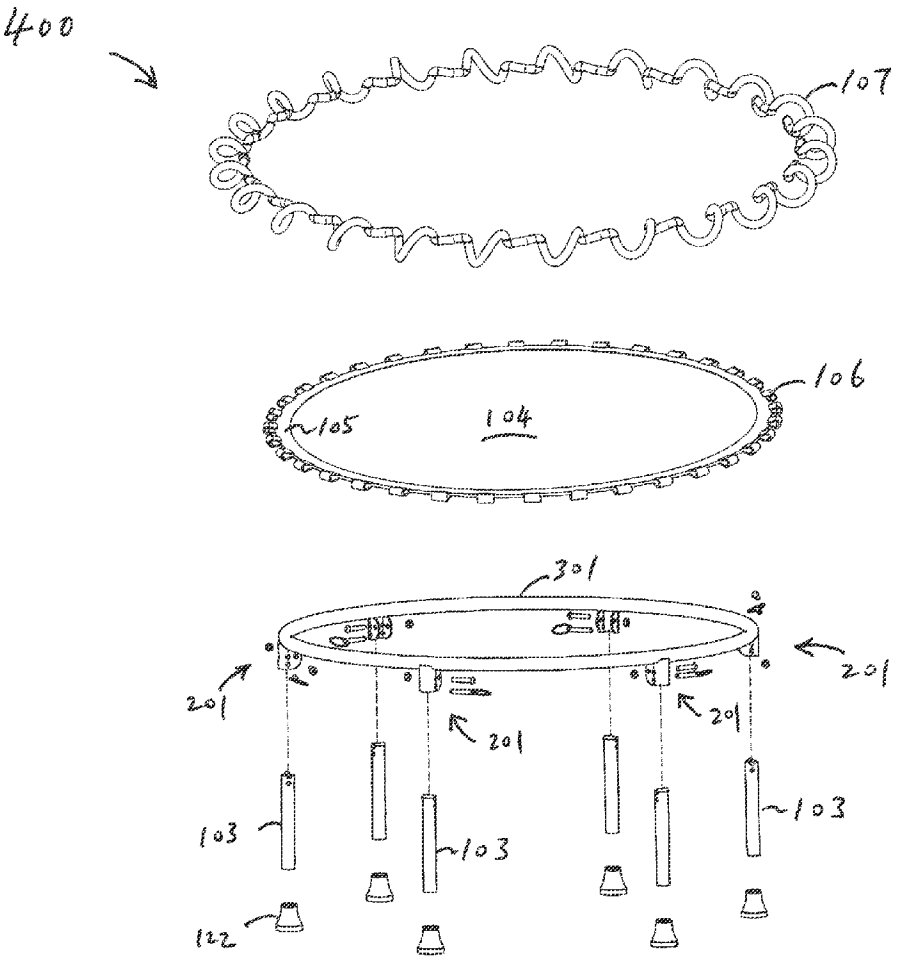
FIG. 17 shows an explosive view of a trampoline device according to one embodiment of the invention.

According to some embodiments, the features of foldable legs can also be applicable to a trampoline device with a non-foldable tubular frame. FIG. 15 shows a perspective view of a trampoline device according to another embodiment of the invention. Referring to FIG. 15, in this embodiment, trampoline device 400 includes tubular frame 301 that is not foldable. However, trampoline device 400 includes each of legs 103 that are attached to tubular frame 301 via a respective leg hinge 201, which has been described above. The same description of leg hinge 201 above can be equally applicable to trampoline device 400. FIG. 16 shows a bottom perspective view of a trampoline device according one embodiment of the invention. FIG. 17 shows an explosive view of a trampoline device according to one embodiment of the invention. Note that, throughout this application, description of different parts or components with the same or similar reference numbers are equally applicable, without unnecessarily repeating.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A foldable trampoline device, comprising:

a tubular frame having a first section and a second section coupled to each other via a pair of frame hinges, wherein each of the first section and the second section is formed in a substantially half circular shape;

a flexible fabric stretched outwardly attached to the tubular frame to form a trampoline mat, wherein the tubular frame is configured in an unfolded position or a folded position via the pair of frame hinges, and at least three legs attached to the tubular frame to provide support and to raise the tubular frame from a support platform when the tubular frame is in the unfolded position, wherein each of the legs is individually foldable without detaching from the tubular frame, wherein when the tubular frame is in the unfolded position, the first section and the second section are laid out flat away from each other via the pair of the frame hinges to form a full-pie shape, wherein when the tubular frame is in the folded position, the first section and the second section are folded towards to each other via the pair of frame hinges to form a half-pie shape, without having to remove the flexible fabric from the first section and second section, wherein each leg is attached to the tubular frame via a leg hinge to allow the leg to be folded inwardly towards a center of the tubular frame when the leg is in the folded position, wherein the leg hinge comprises:

a hinge mounting bracket fixedly attached to the tubular frame, the mounting bracket including a pair of hinge holes;

an elongate tube fixedly attached to an upper end of the leg, wherein an opening of the elongate tube is positioned within the hinge mounting bracket and aligned with the pair of hinge holes; and a hinge rod inserted through the pair of hinge mounting holes and the opening of the elongate tube to form the leg hinge, wherein the leg comprises a pair of first locking holes disposed near the upper end of the leg to lock the leg in an unfolded position or a folded position using a locking pin, and wherein an axis across the first locking holes is parallel with the elongate tube fixedly attached to the upper end of the leg, wherein the hinge mounting bracket comprises a pair of second locking holes vertically aligned with the hinge holes, wherein when the leg is in the unfolded position, the first locking holes of the leg are aligned with the second locking holes to allow the locking pin to be inserted therethrough to lock the leg in the unfolded position in which a longitudinal axis of the leg is substantially perpendicular to a cross plane of the tubular frame, and wherein the hinge mounting bracket further comprises a pair of third locking holes horizontally aligned with the hinge holes, wherein when the leg is in the folded position, the first locking holes of the leg are aligned with the third locking holes to allow the locking pin to be inserted therethrough to lock the leg in the folded position in which the longitudinal axis of the leg is substantially parallel to the cross plane of the tubular frame.

2. The device of claim 1, wherein each of the first section and the second section of the tubular frame comprises a first end and a second end, wherein the first end of the first section is pivotally coupled to the first end of the second section via a first hinge of the frame hinges, and wherein the second end of the first section is pivotally coupled to the second end of the second section via a second hinge of the frame hinges.

3. The device of claim 2, wherein the first hinge comprises:

a first mounting bracket fixedly attached to the first end of the first section of the tubular frame, the first mounting bracket includes a first mounting hole;

a second mounting bracket fixedly attached to the first end of the second section of the tubular frame, the second mounting bracket includes a second mounting hole; and a first rod inserted through the first mounting hole of the first mounting bracket and the second mounting hole of the second mounting bracket to allow the first end of first section and the first end of the second section to rotate with respect to an axis along the first rod.

4. The device of claim 3, wherein the first mounting bracket is a first U-shape bracket having a first pair of mounting holes, wherein the second mounting bracket is a second U-shape bracket having a second pair of mounting holes, and wherein the second U-shape bracket is positioned within a valley of the first U-shape bracket to align the first pair and the second pair of mounting holes to allow the first rod to be inserted therein.

5. The device of claim 4, wherein the first mounting bracket further comprises a first pair of tightening holes to allow a first tightening pin to be inserted to tighten the first U-shape bracket having the second U-shape bracket enclosed therein when the tubular frame is in the unfolded position.

6. The device of claim 5, wherein the first tightening pin is a threaded pin and the tightening holes are threaded holes, and wherein the first tightening pin is inserted into the tightening holes by screwing the threaded pin into the threaded holes to prevent the tubular frame from collapsing from the unfolded position to the folded position.

7. The device of claim 3, wherein the second hinge comprises:

a third mounting bracket fixedly attached to the second end of the second section of the tubular frame, the third mounting bracket includes a third mounting hole;

a fourth mounting bracket fixedly attached to the second end of the first section of the tubular frame, the fourth mounting bracket includes a fourth mounting hole; and a second rod inserted through the third mounting hole of the third mounting bracket and the fourth mounting hole of the fourth mounting bracket to allow the second end of first section and the second end of the second section to rotate with respect to an axis along the second rod.

8. The device of claim 7, wherein the third mounting bracket is a third U-shape bracket having a third pair of mounting holes, wherein the fourth mounting bracket is a fourth U-shape bracket having a fourth pair of mounting holes, and wherein the fourth U-shape bracket is positioned within a valley of the third U-shape bracket to align the third pair and the fourth pair of mounting holes to allow the second rod to be inserted therein.

9. The device of claim 8, wherein the third mounting bracket further comprises a second pair of tightening holes to allow a second tightening pin to be inserted, wherein when the tubular frame is in the unfolded position, the second tightening pin is used to tighten the third U-shape bracket having the fourth U-shape bracket enclosed therein.

10. The device of claim 9, wherein the second tightening pin is a threaded pin and the tightening holes are threaded holes, and wherein the second tightening pin is inserted into the tightening holes by screwing the second threaded pin into the threaded holes to prevent the tubular frame from collapsing from the unfolded position to the folded position.

11. The device of claim 1, wherein the hinge mounting bracket is a U-shape mounting bracket having a U-shape valley, wherein the U-shape valley is substantially conformed to an exterior surface of the leg to allow the leg to be positioned within the U-shape valley, when the leg is in an unfolded position.

12. The device of claim 1, further comprising a plurality of belt loops disposed substantially evenly on an edge portion of the flexible fabric, wherein the edge portion is disposed along a perimeter of the flexible fabric, surrounding a center portion of the flexible fabric.

13. The device of claim 12, wherein the edge portion of the flexible fabric and rest of the flexible fabric are in different colors.

14. The device of claim 12, wherein the edge portion of the flexible fabric is thicker than the center portion of the flexible fabric.

15. The device of claim 1, wherein a diameter of the tubular frame is approximately 36 inches.

16. The device of claim 1, wherein a diameter of the tubular frame is approximately 38 inches.

17. The device of claim 1, wherein a diameter of the tubular frame is approximately 40 inches.

18. The device of claim 1, wherein a height of the device is approximately 8 inches.

19. The device of claim 1, wherein a diameter of the first section and the second section of the tubular frame is approximately 1 inch.

20. The device of claim 1, wherein a diameter of each of the legs is approximately 1 inch.

* * * * *